US011213109B2

(12) United States Patent
Patsalides

(10) Patent No.: US 11,213,109 B2
(45) Date of Patent: Jan. 4, 2022

(54) COSMETIC EYELINER APPLICATOR AND A METHOD OF UTILISATION THEREOF

(71) Applicant: Irene Patsalides, Melbourne (AU)

(72) Inventor: Irene Patsalides, Melbourne (AU)

( * ) Notice: Subject to any disclaimer, the term of this patent is extended or adjusted under 35 U.S.C. 154(b) by 389 days.

(21) Appl. No.: 16/481,229

(22) PCT Filed: Feb. 1, 2018

(86) PCT No.: PCT/AU2018/050063
§ 371 (c)(1),
(2) Date: Jul. 26, 2019

(87) PCT Pub. No.: WO2018/141014
PCT Pub. Date: Aug. 9, 2018

(65) Prior Publication Data

US 2019/0387863 A1 Dec. 26, 2019

(30) Foreign Application Priority Data

Feb. 1, 2017 (AU) ..... 2017900295

(51) Int. Cl.
*A45D 40/20* (2006.01)
*A45D 34/04* (2006.01)

(52) U.S. Cl.
CPC ..... *A45D 40/20* (2013.01); *A45D 34/04* (2013.01); *A45D 2200/1009* (2013.01); *A45D 2200/1072* (2013.01)

(58) Field of Classification Search
CPC ..... A45D 40/20; A45D 40/205; A45D 34/00; A45D 34/04; A45D 2200/1072;
(Continued)

(56) References Cited

U.S. PATENT DOCUMENTS

D339,235 S 9/1993 Hirzel
D421,302 S 2/2000 Korteweg
(Continued)

FOREIGN PATENT DOCUMENTS

FR 3012946 A1 5/2015
WO 2015071818 A1 5/2015
(Continued)

OTHER PUBLICATIONS

International Search Report dated May 9, 2018 from PCT Application No. PCT/AU2018/050063.

*Primary Examiner* — David J Walczak
(74) *Attorney, Agent, or Firm* — Innovation Capital Law Group, LLP; Vic Lin

(57) ABSTRACT

A tip for a cosmetic eyeliner allows for the convenient and accurate application of cosmetic eyeliner. The tip comprises a generally elongate cosmetic impregnated or coated body shaped to define a nib at a distal end thereof. The nib is of generally triangular cross-section along an elongate axis of the tip so as to define two lateral faces meeting at a rearward edge thereof and a forward face between the lateral faces. The forward facing and the two lateral faces meet at a point at a distal end of the nib. As such, in use, the tip allows for the convenient application of eyeliner cosmetic wherein the forward face is configured for stamping a cosmetic wing shape and an outer edge of an eye when the nib is in a first angle of rotation.

14 Claims, 9 Drawing Sheets

(58) Field of Classification Search
CPC ..... A45D 2200/00; A45D 2200/10; A45D 2200/109; A45D 2200/1018; A45D 2200/1036; A45D 40/26
USPC ..... 401/198, 199, 6, 9, 11, 261, 207; D28/4, D28/7; D4/137
See application file for complete search history.

(56) References Cited

U.S. PATENT DOCUMENTS

| | | | | |
|---|---|---|---|---|
| D450,165 | S | 11/2001 | Osiecki et al. | |
| D527,974 | S | 9/2006 | Petersen et al. | |
| D578,717 | S | 10/2008 | Trueheart | |
| D623,371 | S | 9/2010 | Li | |
| D758,008 | S | 5/2016 | Kolby et al. | |
| D822,277 | S | 7/2018 | Xavier et al. | |
| D836,245 | S | 12/2018 | Stawinski et al. | |
| D851,329 | S | 6/2019 | Celia | |
| 10,517,370 | B2 * | 12/2019 | Caulier | A45D 34/04 |
| 2007/0017544 | A1 * | 1/2007 | Gueret | A45D 34/045 132/320 |
| 2016/0286936 | A1 | 10/2016 | Ashburn | |
| 2018/0325238 | A1 * | 11/2018 | Gabon | A45D 40/26 |

FOREIGN PATENT DOCUMENTS

| | | | |
|---|---|---|---|
| WO | 2016050956 | A1 | 4/2016 |
| WO | 2016184724 | A1 | 11/2016 |

* cited by examiner

COSMETIC EYELINER APPLICATOR AND A METHOD OF UTILISATION THEREOF

FIELD OF THE INVENTION

This invention relates generally to cosmetic applicators more particularly, this invention relates to eyeliner cosmetic applicators.

BACKGROUND OF THE INVENTION

Eyeliner cosmetic is applied to eyes for the cosmetic enhancement thereof. Application of cosmetic requires skill to achieve an appropriate and desirous visually appealing application thereof.

The present invention seeks to provide a cosmetic eyeliner allowing for the convenient and accurate application of eyeliner cosmetic, which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

In accordance with a first embodiment, there is provided herein a tip for a cosmetic eyeliner allowing for the convenient and accurate application of cosmetic eyeliner.

Specifically, the tip comprises a generally elongate cosmetic impregnated or coated body shaped to define a nib at a distal end thereof.

The nib is of generally triangular cross-section along an elongate axis of the tip so as to define two lateral faces meeting at a rearward edge thereof and a forward face between the lateral faces. The forward facing and the two lateral faces meet at a point at a distal end of the nib.

As such, in use, the tip allows for the convenient application of eyeliner cosmetic wherein the forward face is configured for stamping a cosmetic wing shape and an outer edge of an eye when the nib is in a first angle of rotation.

Then, the nib may be rotated to a second opposite angle of rotation such that the rearward edge and the tip are configured for eyelid linework of the cosmetic inward from the wing shape. As the user draws the rearward edge along the eyelid, the angle of the applicator may be increased with respect to the eye from a more tangential to a more perpendicular angle such that the point of the nib becomes of greater prominence allowing the linework to taper as is desirous towards the inner edge of the eye.

In embodiments, the forward face may have convex curvature along the elongate axis and/or orthogonal to the elongate axis allowing for the rolling application of cosmetic, enhancing the adherence and application thereof.

In a preferred embodiment, the nib is offset away from the elongate axis of the tip so as to further enhance the utilisation thereof.

Specifically, with regards to stamping, the tip may comprise a waist adjoining the nib at a proximal end thereof, the waist defining an outer perimeter cross-section. The waist may be generally cylindrical for the insertion thereof into a barrel of an applicator. The proximal edge of the forward face may extend beyond the outer perimeter cross-section of the waist such as by approximately 1.8 mm in embodiments. As such, when the waist is engaged within the barrel of an applicator, the forward face extends from beyond the outer sides of the barrel such that the barrel does not interfere with the eyeball or eyelashes.

Furthermore, with regards to linework, the rearward edge may intersect the elongate axis of the tip. Furthermore, in embodiments, a proximal end of the rearward edge may lie within the outer perimeter cross-section of the waist. Such configuration biases the rotational orientation of the tip when applying linework such that the rearward edge tends towards the eyelid, allowing greater control thereof during the application of linework.

There is also provided herein an eyeliner applicator having a nib in accordance with a second embodiment. In accordance with this second embodiment, the nib is characterised in being substantially wedge-shaped. Such a wedge-shaped may define a front face and a rear face which meet at a distal edge. Furthermore, the nib may define a proximal face. In a first configuration, a stem supports the nib from the proximal face, and, in a second configuration, the stem supports the nib from the front face. In either configuration, the nib define lateral faces of appropriate curvature for the convenient stamping of wing shapes of appropriate shape at outer edges of the eye. The nib of the two configurations allows for either the outward handed or inward handed holding of the applicator.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

FIGS. 1-5 show various views of a tip 100 for a cosmetic eyeliner. The tip 100 comprises a generally elongate cosmetic impregnated or coated body shaped to define a nib 105 at a distal end thereof.

Figure 1:
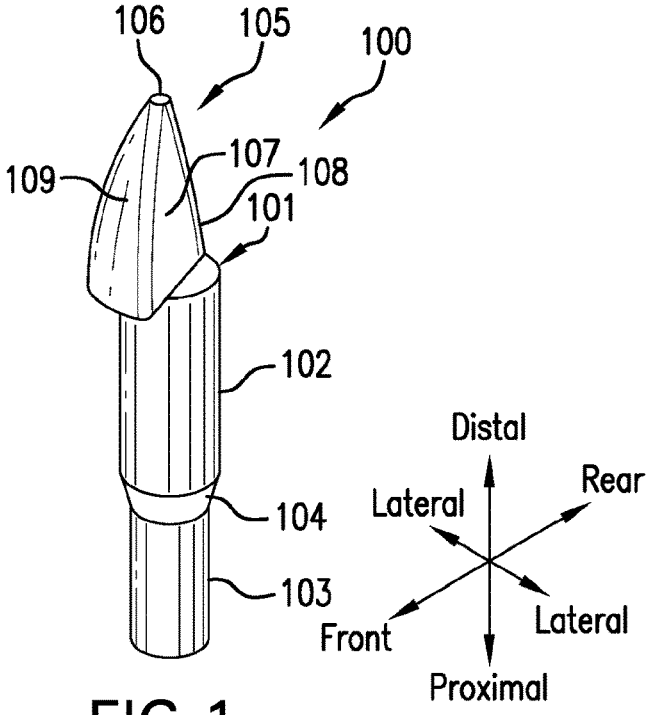
FIGS. 1-5 show differing views of a tip for a cosmetic applicator in accordance with an embodiment.

For orientational convenience, the orientational nomenclature of the axes shown in FIG. 1 will be utilised hereafter wherein there will be described the tip 100 comprising a distal end towards a point 106 and a proximal end towards a handle/barrel thereof. Furthermore, the tip 100 comprises front and rear sides and lateral sides therebetween.

Figure 6:
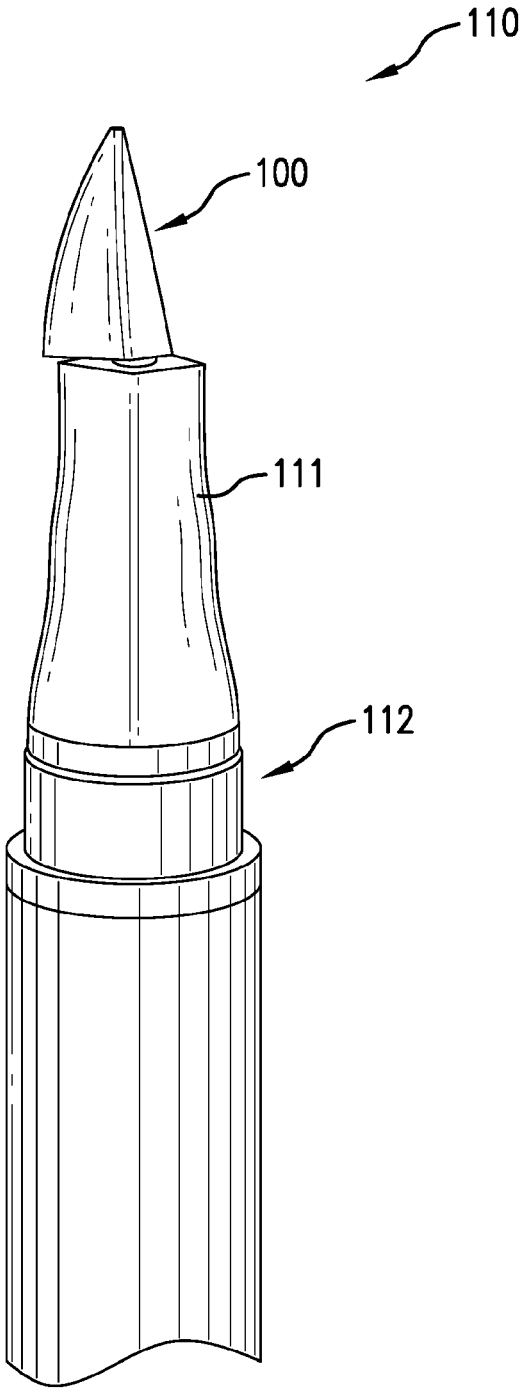
FIG. 6 illustrates the engagement of the tip within a barrel of the cosmetic applicator in accordance with an embodiment.

The tip 100 is configured for insertion within a barrel 111 of a cosmetic eyeliner tool 110 as is substantially shown in FIG. 6. The distal end of the barrel 111 may comprise a lid engagement formation 112 for engaging a lid for protecting the tip 100. In embodiments, the tip 100 may draw cosmetic from a reservoir therein.

In this regard, the tip 100 may be manufactured from a suitably impregnable material, such as foam, sponge or the like. In alternative embodiments, the tip 100 is nonporous such as by being manufactured from plastic or the like and rather dipped in cosmetic. In embodiments, the tip 100 may be shaved into the particular configuration disclosed herein from a larger piece during manufacture, such as by being ground from a rod.

The nib 105 is impregnated or coated with eyeliner cosmetic for the convenient application thereof in the manner described herein.

Figure 2:
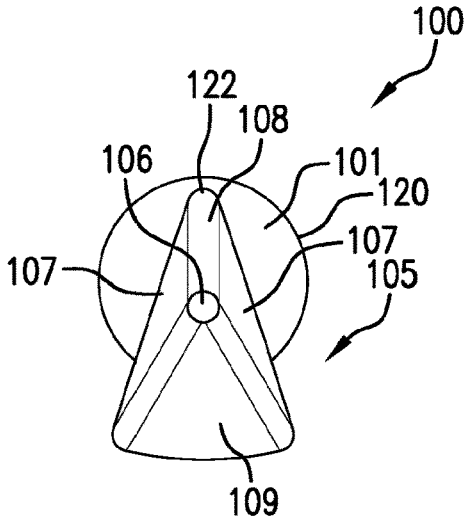

As is substantially shown in FIG. 2, the nib 105 comprises a generally triangular cross section along an elongate axis of the tip 100 thereby defining two lateral faces 107 meeting at a rearward edge 108 thereof. Furthermore, a forward face 109 is defined between the lateral faces 107. The forward face 109 and the two lateral faces 107 meet at a point 106 at a distal end of the nib 105.

Figure 7:
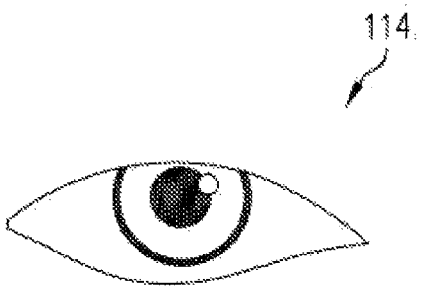
FIGS. 7-9 illustrate the application of eyeliner utilising the tip in accordance with an embodiment.

Utilisation of the tip 100 will now be described with reference to illustrative FIGS. 7-9. FIG. 7 shows an eye 114 of a user for the application of cosmetic eyeliner thereto.

Figure 8:
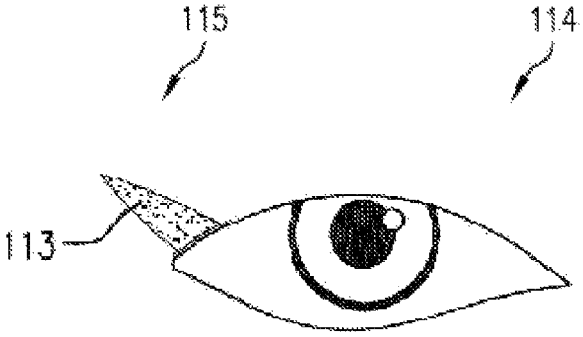

With reference to FIG. 8, the forward face 109 is configured for stamping the cosmetic in a wing shape 113 at an outer edge 115 of the eye 114 when the nib 105 is in a first angle of orientation wherein the forward face 109 faces the eye 114.

The distally tapering profile of the forward face 109 allows the wing shape 113 to be stamped easily, conveniently and of appropriate shape.

Figure 5:
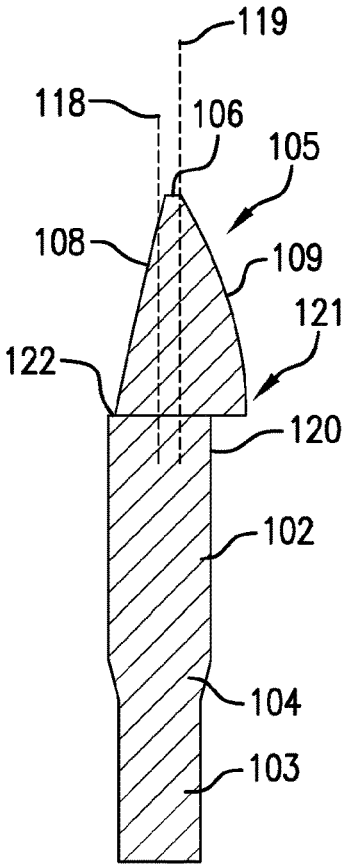

As can be appreciated from FIG. 5, in an embodiment, the forward face 109 comprises a convex curvature 109 along the elongate axis. Furthermore, as can be appreciated from FIG. 2, in an embodiment, the forward face 109 additionally or alternatively comprises a convex curvature orthogonal to the elongate axis. Such a convex curvature allows the rolling of the forward face 109 across the outer edge 115 of the eye 114 to form the wing shape 113, enhancing the application of the cosmetic thereto.

Figure 11:
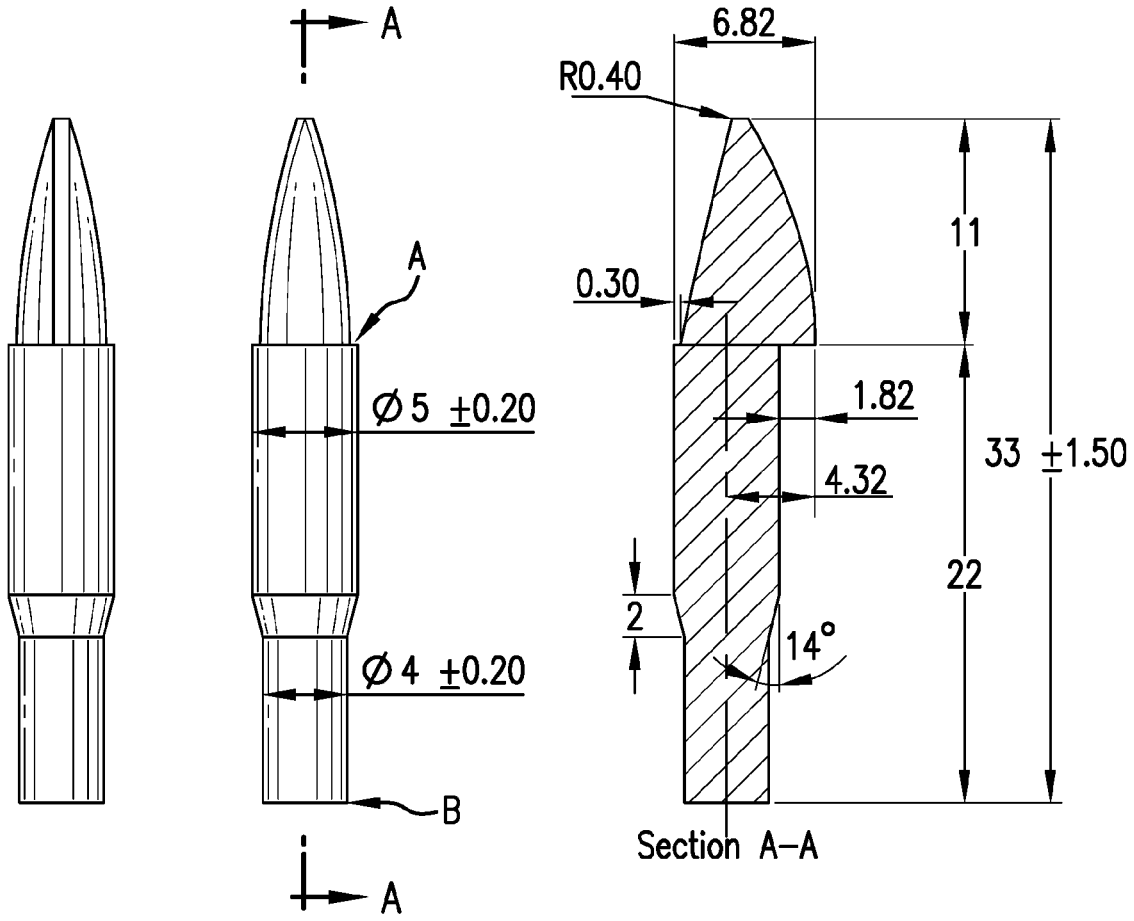

As is illustrated from the exemplary dimensions of FIGS. 11-15, the tip 100 and especially the nib 105 may be provided in differing dimensions. For example, the proximal end of the rearward edge can terminate within the outer perimeter cross section by approximately 0.3 mm, as shown in FIG. 11. Further, by example, the nib can comprise a width of approximately 7 mm, such as 6.82 mm as illustrated in FIG. 11, between a proximal edge of the forward face and a proximal end of the rearward edge.

Figure 12:
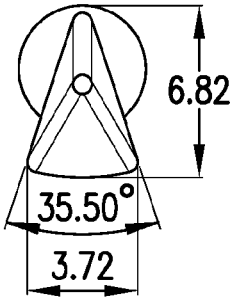
FIGS. 12-15 illustrate exemplary dimensions of the tip having two differing sizes in accordance of the stamping of differing sized wing shapes with an embodiment.
Figure 13:
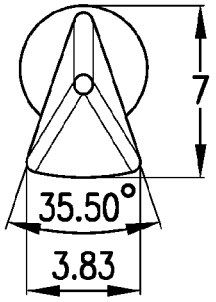

With respect to the forward face 109, as can be appreciated from FIG. 12, the proximal edge of the forward face 109 may comprise a width of approximately 3.72 mm and may arc through approximately 35°. FIG. 13 shows an embodiment wherein the nib 105 is of greater dimension such that the proximal edge of the forward face 109 comprises a width of approximately 3.83 mm, yet having substantially the same arc.

Figure 14:
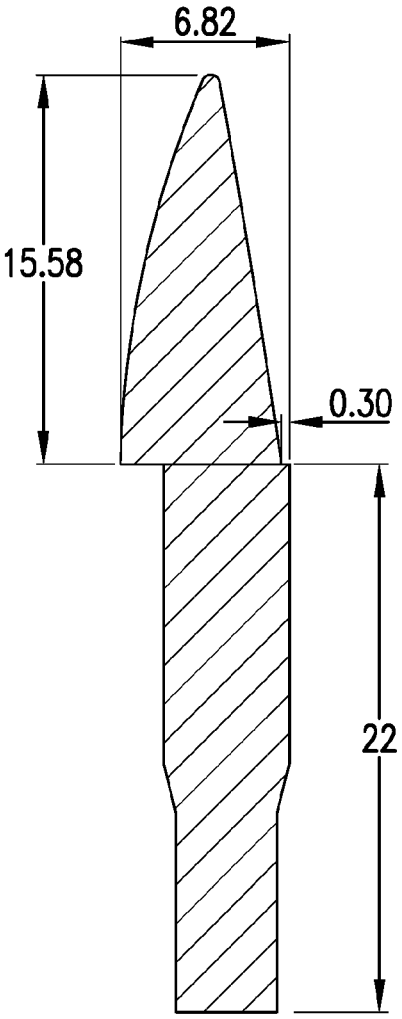
Figure 15:
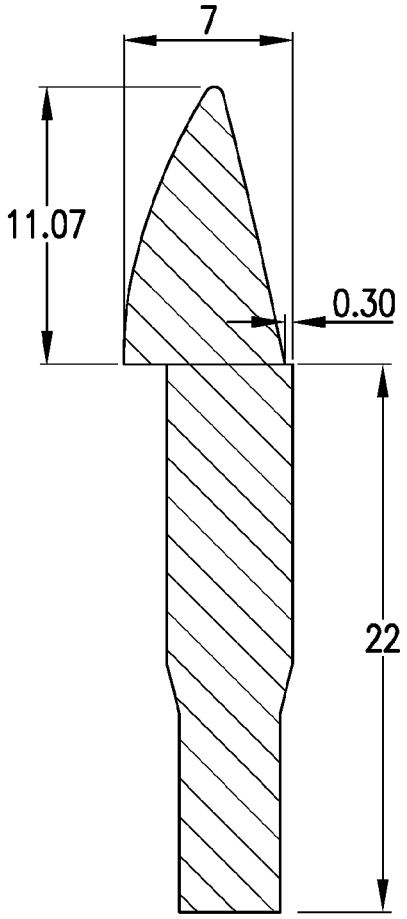
Figure 16:
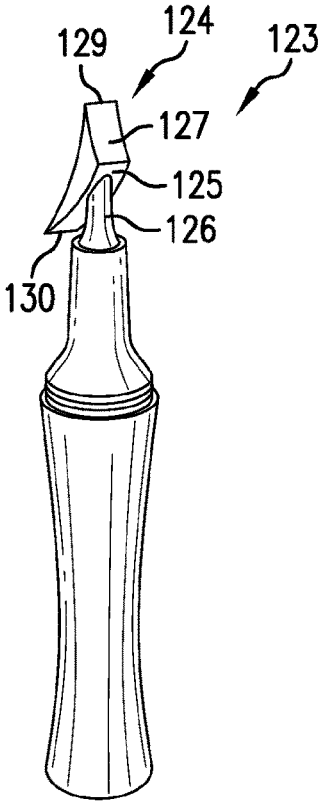
FIGS. 16-19 show various views of a tip for a cosmetic eyeliner in accordance with a second embodiment.
Figure 17:
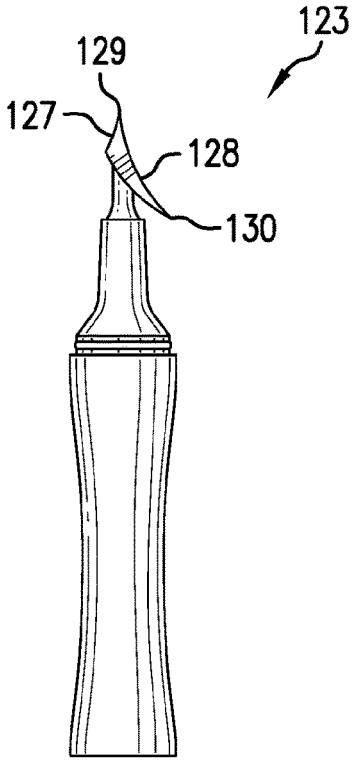
Figure 18:
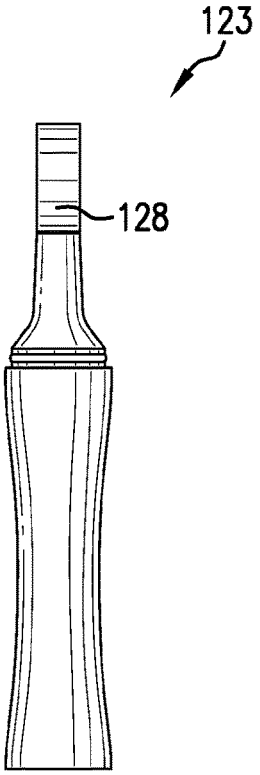
Figure 19:
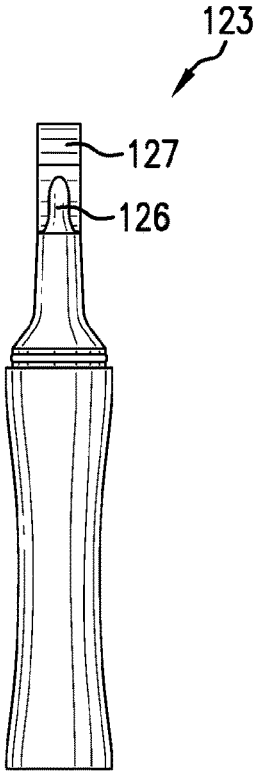

FIGS. 14 and 15 illustrate the nib 105 comprising differing lengths along the elongate axis of the tip 100. Specifically, FIG. 14 illustrates a more elongate version wherein the nib 105 comprises a length of approximately 16 mm as compared to the more shorter version of FIG. 15 wherein the nib 105 comprises a length of approximately 11 mm.

In accordance with various embodiments, the forward face 109 may arc between 25 and 50° and may span between 2 mm and 10 mm. Furthermore, the length of the nib 105 between the forward face 109 and the rear edge 108 may comprise a length of between 3 and 8 mm at a proximal end thereof in embodiments.

As such, utilising the nib 105 of the embodiment shown in FIGS. 12 and 14, user is able to stamp a wing shape 113 being approximately 16 mm in length and approximately 3.72 mm wide at the widest edge thereof. Conversely, utilising the nib 105 of the embodiment shown in FIG. 13 and 15, user is able to stamp a wing shape 113 comprising a shorter length of approximately 11 mm and a width of approximately 3.83 mm at the widest edge thereof.

In embodiments, a plurality of cosmetic applicators tools 110 may be provided having tips 100 of differing dimensions allowing for the convenient formation of differing wing shapes 113.

Having stamped the wing shape 113 at the outer edge 115 of the eye 114 as is substantially shown in FIG. 8, the user is able to perform linework 116 towards an inner edge 117 of the eye 114.

Specifically, the user would rotate the tool 110 to a second angle of rotation, being generally opposite to that of the first angle of rotation such that the forward face 109 faces away from the eye 114 and the rearward edge 108 faces towards the upper eyelid of the eye 114.

Figure 9:
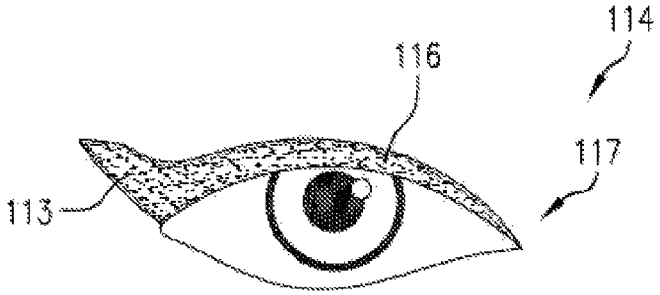
Figure 10:
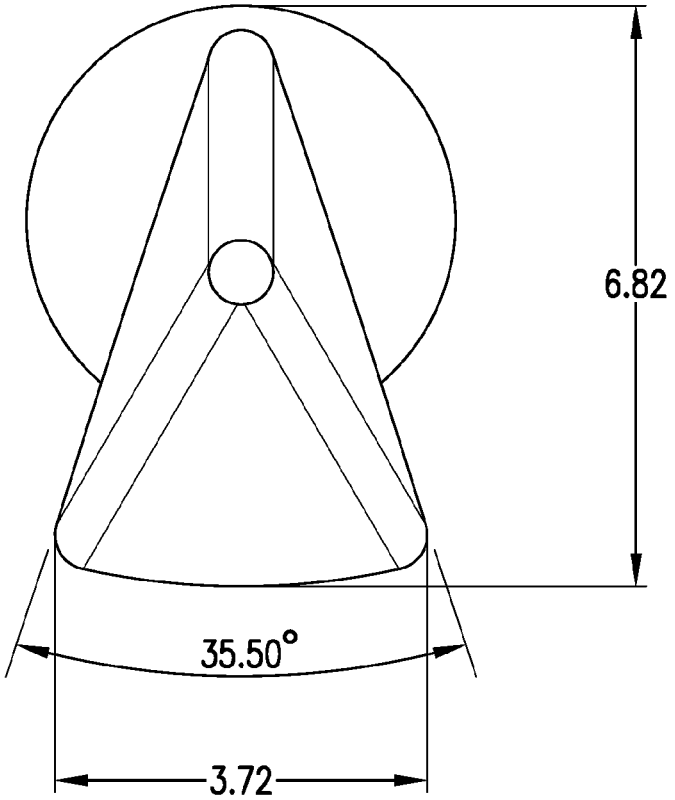
FIGS. 10-11 illustrates exemplary dimensions of the tip in accordance with an embodiment.

The user then draws the nib 115 inwardly across the eyelid applying the cosmetic according to the linework 116 shown in FIG. 9. As the user draws the rearward edge 108 across the upper eyelid, the user may simultaneously increase the angle of the barrel 110 with respect to the eye 114 from a more tangential to a more perpendicular angle. As such, the point 106 is more prominently employed towards the inner edge of the eye 117 allowing the linework 116 to taper towards the inner edge of the eye 117 as is illustrated in FIG. 9.

In a preferred embodiment, the nib 105 is offset with respect to an elongate axis 118 of the tip 100.

Specifically, with reference to FIG. 5, there is shown the cross-section of the tip 100 defining the elongate axis 118 therethrough and the top 106 being offset away from the elongate axis 118. Specifically, the nib 105 may similarly define an elongate axis 119 through the point 106 thereof wherein, as can be seen from FIG. 5, the nib elongate axis 119 is offset laterally with respect to the elongate axis 118.

The offsetting of the nib 105 away from the elongate axis 118 of the tip 100 enhances the functionality thereof when applying cosmetic.

Specifically, as can be seen from FIG. 5, the tip 100 may define an elongate waist 102 adjoining the nib 105 at a proximal end thereof. The waist 102 is configured for insertion within the barrel 111 as alluded to above. The waist 102 may define an outer perimeter cross-section 120 along the elongate axis 118 and wherein the forward face 109 extends forwardly beyond the outer perimeter cross-section 120 is as illustrated in FIGS. 2 and 5.

In the embodiment illustrated in FIG. 11, the proximal end 121 of the forward face 109 may overhang the outer perimeter cross-section 120 by approximately 1.8 mm.

Such an offset configuration allows a proximal edge 121 of the forward face 109 to extend beyond the outer periphery of the barrel 111 is substantially illustrated in FIG. 6, thereby avoiding and desirous contact with the eyeball or eyelashes.

Furthermore, with reference to the rearward edge 108, as is also illustrated in FIG. 5, the rearward edge 108 may intersect the elongate axis 119 of the tip 100 such that the point 106 is offset forwardly with respect to the elongate axis 119. As such, when applying the linework 116, pressure applied to the rearward edge 108, especially the distal end thereof, bias is the rotation of the tip such that the rearward end 108 tends toward the eyelid.

Furthermore, in embodiments, a proximal end 122 of the rearward edge 108 may terminate within the outer perimeter cross-section 120 is a substantially illustrated in FIGS. 2 and 5. Such a configuration again biases the rotation of the tip 100 such that the rearward edge 108 tends to face the eyelid during the application of the linework 116. In alternative embodiments, the proximal end 122 may meet at the outer perimeter 120. In embodiments, the proximal end 122 may extend beyond the outer perimeter 120 so as to extend beyond the thickness of the plastic barrel 111 of the tool 110.

Furthermore, whereas the embodiments show the point 106 and lateral edges of the nib 105 being rounded by approximately 0.4 mm in diameter, in embodiments, the point 106 may be sharp and may meet a sharp rear edge 108 at an apex thereof providing for very fine line work.

Figure 3:
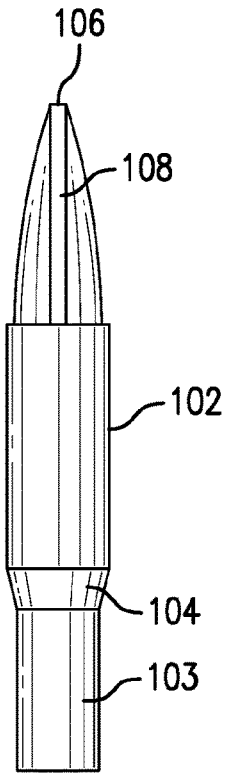
Figure 4:
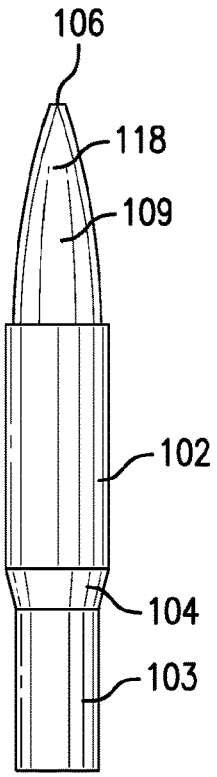

In the embodiment shown in FIGS. 3-5, the tip 100 may transition at a neck 104 to a tail 103 of lesser dimension than that of the waist 102.

FIGS. 16-22 illustrates a cosmetic eyeliner applicator 123 in accordance with a second embodiment.

As can be seen from FIGS. 16-19, the applicator 123 is characterised in comprising a generally wedge-shaped nib 124. The nib 124 may define a proximal face 125 adjoining a stem 126 supporting the nib 124.

The nib 124 may be wedge-shaped orthogonal to an elongate axis of the stem 126. Specifically, the nib 124 may define a front face 127 and a rear face 128 which meet at a distal edge 129. Furthermore, the proximal face 125 and the rearward face 128 may meet at a proximal edge 130.

Figure 20:
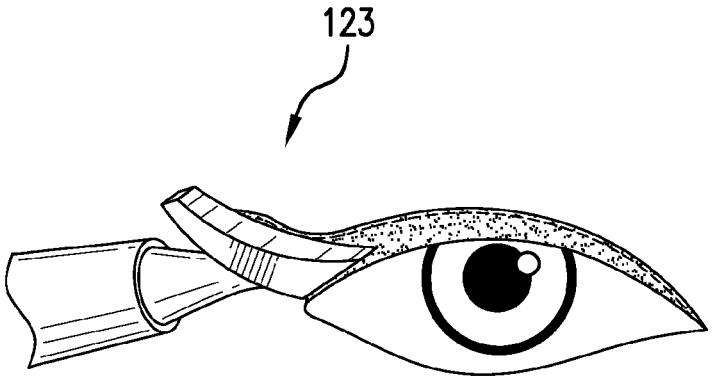
FIGS. 20 and 21 show the respective outer handed and inner handed utilisation of the cosmetic eyeliner tip of the second embodiment.
Figure 21:
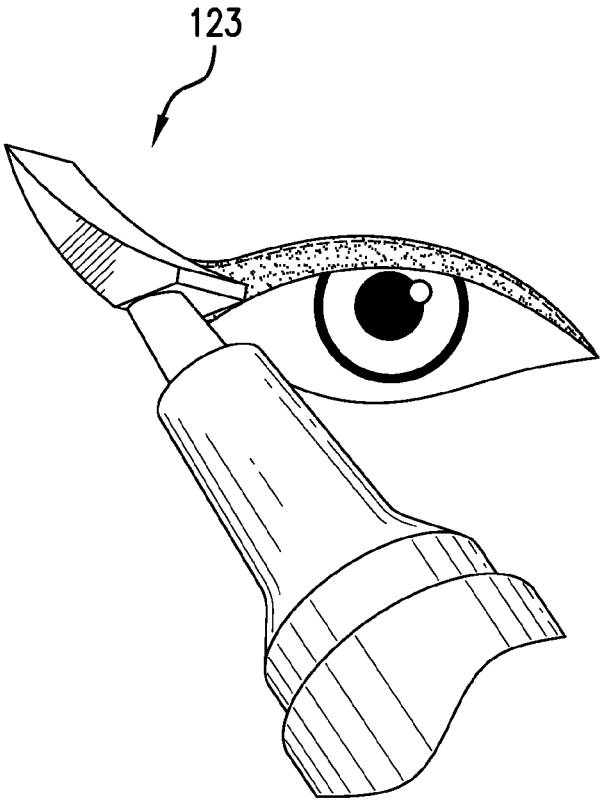
Figure 22:
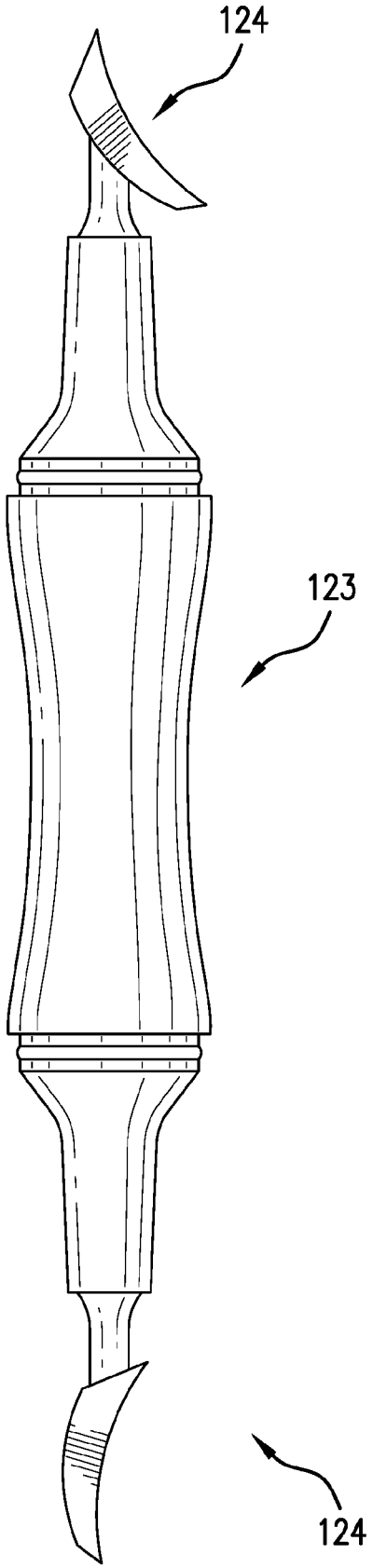
FIG. 22 illustrates the cosmetic eyeliner comprising the cosmetic eyeliner tip of the second embodiment of the two differing configurations for the outer and inner handed application thereof.

In embodiments, the orientation of the nib 124 may be reversed as is substantially illustrated in FIGS. 20-22 wherein, as opposed to the stem 126 adjoining the proximal face 125 of the nib as is substantially shown in FIG. 16-19, the stem 126 rather engages the front face 127.

As such, the nib 124 in accordance with the first configuration illustrated in FIG. 16-19 may be utilised for the outwardly held stamping of the wing shape 113 as is substantially illustrated in FIG. 20.

Furthermore, the nib 124 in accordance of the second configuration may be utilised for the inwardly held stamping of the wing shape as is substantially illustrated in FIG. 21.

FIG. 22 illustrates an embodiment of the tool 123 comprising nib is 124 of both of these configurations at opposite ends thereof.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

The invention claimed is:

1. A tip for a cosmetic eyeliner comprising a generally elongate cosmetic impregnated body shaped to define a nib at a distal end thereof, the nib comprising two generally triangular lateral sides which are angled from a straight rearward edge therebetween, the rearward edge slanting in towards a distal point of the nib, each lateral sides narrowing distally towards the point and parting from the rearward edge to respectively meet a generally triangular forward face at an opposite front side, the forward face narrowing distally towards the point and being convex both along and orthogonal to the elongate axis of the nib and arcing through more than 25° with respect to an elongate axis of the tip.

2. A tip for a cosmetic eyeliner as claimed in claim 1, wherein the forward face arcs through more than 35° with respect to the elongate axis.

3. A tip for a cosmetic eyeliner as claimed in claim 1, wherein the nib is offset with respect to the elongate axis of the tip.

4. A tip for a cosmetic eyeliner as claimed in claim 3, wherein the point of the tip is offset forwardly away from the elongate axis of the nib.

5. A tip for a cosmetic eyeliner as claimed in claim 4, wherein the rearward edge intersects the elongate axis.

6. A tip for a cosmetic eyeliner as claimed in claim 1, wherein the body is shaped to define an elongate waist proximally adjoining the nib and wherein the waist defines an outer perimeter cross section along the elongate axis and wherein the forward face extends forward beyond the outer perimeter cross section.

7. A tip for a cosmetic eyeliner as claimed in claim 6, wherein the forward face extends forward beyond outer perimeter by approximately 1.8 mm.

8. A tip for a cosmetic eyeliner as claimed in claim 6, wherein a proximal end of the rearward edge terminates within the outer perimeter cross section.

9. A tip for a cosmetic eyeliner as claimed in claim 8, wherein the proximal end of the rearward edge terminates within the outer perimeter cross section by approximately 0.3 mm.

10. A tip for a cosmetic eyeliner as claimed in claim 6, wherein the waist is cylindrical.

11. A tip for a cosmetic eyeliner as claimed in claim 6, wherein the waist transitions to a tail at a proximal end thereof and wherein the tail is of lesser diameter than that of the waist.

12. A tip for a cosmetic eyeliner as claimed in claim 1, wherein the nib comprises a width of approximately 7 mm between a proximal edge of the forward face and a proximal end of the rearward edge.

13. A tip for a cosmetic eyeliner as claimed in claim 1, wherein the nib comprises a length along the elongate axis of approximately 11 mm.

14. A tip for a cosmetic eyeliner as claimed in claim 1, wherein the nib comprises a length along the elongate axis of approximately 16 mm.

* * * * *